US005799925A

United States Patent [19]

Kumita et al.

[11] Patent Number: 5,799,925

[45] Date of Patent: Sep. 1, 1998

[54] TILT LOCK FOR OUTBOARD MOTOR

[75] Inventors: Atsushi Kumita; Manabu Yamamoto, both of Hamamatsu, Japan

[73] Assignee: Sanshin Kogyo Kabushiki Kaisha, Hamamatsu, Japan

[21] Appl. No.: 635,721

[22] Filed: Apr. 22, 1996

[30] Foreign Application Priority Data

Apr. 21, 1995 [JP] Japan ..... 7-097189

[51] Int. Cl.[6] ..... F16M 1/00

[52] U.S. Cl. ..... 248/642; 440/900

[58] Field of Search ..... 248/642, 643, 248/640, 641; 440/900, 53, 55

[56] References Cited

U.S. PATENT DOCUMENTS 3,511,460 5/1970 Shimanckas ..... 248/642
4,557,460 12/1985 Nakase ..... 248/642
4,759,733 7/1988 Nishimura ..... 440/55
4,930,744 6/1990 Woodward et al. ..... 248/642
5,498,181 3/1996 Anselm et al. ..... 440/53
5,514,012 5/1996 Natsume ..... 440/53

*Primary Examiner*—Ramon O. Ramirez
*Attorney, Agent, or Firm*—Knobbe, Martens, Olson & Bear LLP

[57] ABSTRACT

A tilting assembly for an outboard drive unit including a tilt locking means for selectively engaging a stop member, a tilt releasing means for disengaging the locking means from the stop member, a tilt holding means for selectively engaging a holder portion of a clamp bracket and a biasing means for biasing the holding means towards or away from the holder portion of the clamp bracket. The releasing means and biasing means are operatively associated through a single-piece lever that is configured so that the holding means is biased away from the holder portion when the stopping member is engaged by the locking means and towards the holder portion when the stopping member is disengaged from the locking means.

7 Claims, 5 Drawing Sheets

TILT LOCK FOR OUTBOARD MOTOR

BACKGROUND OF THE INVENTION

This invention relates generally to a tilting assembly for an outboard drive unit, and more particularly, to an improved tilt locking and holding assembly for an outboard drive unit.

An outboard drive unit, which may comprise an outboard motor or the outboard drive portion of an inboard/outboard drive, typically employs an arrangement for supporting the drive unit for pivotal movement about a generally horizontal extending tilt axis. This pivotal movement is provided to adjust the trim of the drive unit to suit varied running conditions and to tilt the drive unit to an out-of-the-water position for servicing, storage, trailering or the like. It is also conventional practice to employ some form of mechanical locking and holding assembly to maintain the outboard drive unit in the tilted-down position under normal running conditions and to hold the outboard drive in its tilted-up position when desired.

It has been recognized in the past that is it advantageous to bias a holder arm against a notched portion of a clamping bracket upon raising the drive unit to a tilted-up position in order to facilitate the tilting-up procedure. The drive unit is tilted up until the holder arm is at a point slightly higher than a set of notches corresponding to a desired tilt angle of the outboard unit. Because the holder arm is biased against the notched portion above the notches, the drive unit can be lowered into the notches without having to separately engage the holder arm into the notches while raising the drive unit. It has been similarly recognized in the past that it is advantageous when lowering the drive unit to have the holder arm biased away from the notched portion so that the holder arm does not catch on the notched portion.

An example of a tilting assembly that recognizes these advantages employs a lock arm which is supported on a swivel bracket of the drive unit and is adapted to releasably engage a pin on the clamp bracket of the drive units, a holder arm is also pivotally supported on the swivel bracket and is engageable with a holder portion formed on the clamp bracket for holding the outboard drive unit in a partially or fully tilted-up state. An operating lever is provided for operating a pair of levers. One of these two levers engages and disengages the lock arm and the other lever biases the holder arm towards or away from the holder portion to achieve the above-described advantages.

Although this type of assembly is generally satisfactory, using a plurality of levers to engage and disengage the lock arm and bias the holder arm increases the complexity and cost of manufacture of the tilting assembly.

It is therefore a principal object of this invention to provide an improved tilting assembly for an outboard drive unit that includes a single lever which is controlled by an operating lever, that engages and disengages the lock arm and biases the holder arm during tilting operation of the outboard drive unit in order to simplify manufacturability of the tilt assembly and the costs associated therewith.

It is desirable in the above-described tilt assembly to design the tilt assembly so that the lock arm remains engaged with a stop pin for locking the outboard unit in a tilted-down position until the holder arm is biased against the notched portions of the clamp bracket. This design prevents the outboard unit from being tilted up without the holder arm being in a position ready to be engaged with the notched portions of the clamp bracket.

Therefore, it is a further object of the present invention to provide an improved tilting assembly for an outboard drive unit that includes a single lever configured to bias the holder portion against the notched portion of the clamp bracket upon disengagement of the lock arm to facilitate engagement of the holder arm with the notched portion when raising the outboard unit to a tilted-up position.

In the past, tilting assemblies have been designed that allow the lock arm to release from the stop pin when the outboard unit strikes an underwater obstacle so that the outboard unit may freely rotate about its tilt axis to prevent damage to the outboard unit and the transom of an associated boat. In the above-described tilting assembly, it is further desirable to prevent the holder arm from being biased against the notched portion of the clamp bracket when the outboard unit strikes the underwater obstacle. If this is not prevented, the holder arm may become accidentally engaged in the notched portions of the clamp bracket when the outboard unit is caused to rotate about its tilt axis upon striking the underwater obstacle.

It is therefore, a further object of the present invention to provide an improved tilting assembly for an outboard drive unit that is designed to prevent the holder arm from being biased against the notched portion of the claim bracket upon striking an underwater obstacle.

SUMMARY OF THE INVENTION

This invention is adapted to be embodied in a tilting assembly for an outboard drive unit of a watercraft that comprises a clamp bracket with a holder portion. The clamp bracket is adapted to be affixed to the transom of the watercraft. A swivel bracket is pivotally mounted to the clamp bracket for tilting movement between a tilted-down position and a tilted-up position. A stop member is secured to the clamp bracket. The tilting assembly includes means for locking the swivel bracket to the stop member for setting the tilted-down position. The means for locking the swivel bracket to the stop member are pivotally mounted to the swivel bracket. The locking means are also selectively engageable with the stop member. The tilting assembly further includes means for releasing the locking means from the stop member. The releasing means are pivotally mounted to the swivel bracket. The tilting assembly includes means for holding the swivel bracket in a tilted-up position in the holder portions of the clamp bracket. The holding means are pivotally mounted to the swivel bracket and selectively engageable with the holder portion. The tilting assembly also includes means for biasing the holding means towards the holder portion or away from the holder portion. The means for biasing are pivotally mounted to the swivel bracket. The biasing means are operatively associated with the releasing means so that the holding means are biased away from the holder portion when the stopping member is engaged by the locking means and towards the holder portion when the stopping member is disengaged from the locking means. The biasing means and releasing means are pivotally mounted to the swivel bracket through a single-piece lever that is configured to allow the operative association between the biasing means and releasing means.

DETAILED DESCRIPTION OF THE PREFERRED EMBODIMENTS OF THE INVENTION

Figure 1:
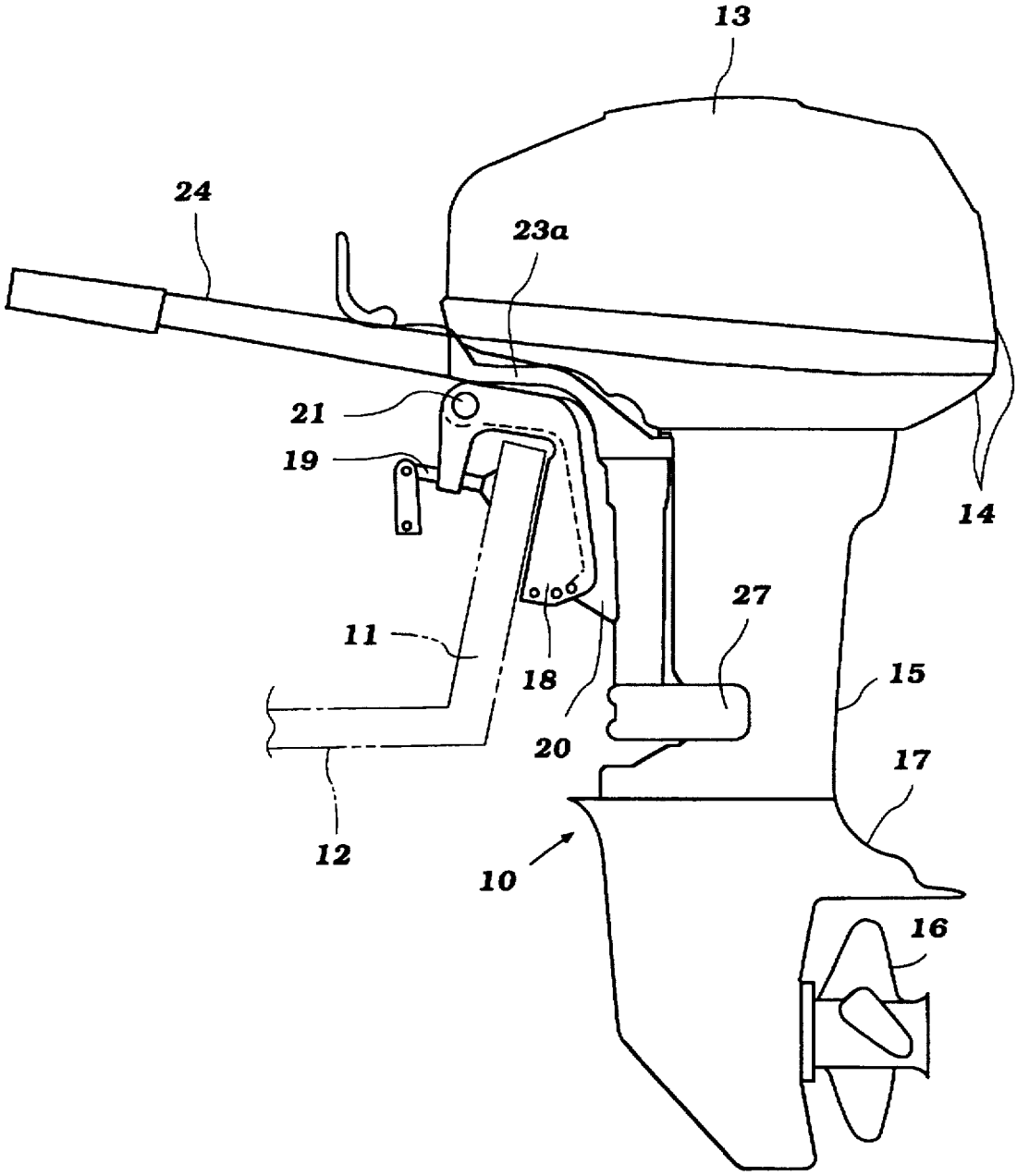
FIG. 1 is a side elevational view of an outboard motor attached to the transom of an associated watercraft shown in the tilted-down position.

Referring first to FIG. 1, an outboard drive unit in the form of an outboard motor, indicated generally by the reference numeral 10, is mounted on the transom 11 of a hull 12 of an associated watercraft. Although the invention is described in conjunction with an outboard motor, it is to be understood that the invention may equally as well be practiced with the outboard drive portion of an inboard/outboard drive. However, the invention has particular utility in connection with an outboard motor.

The outboard motor is comprised of a powerhead, indicated generally by the reference numeral 13, which includes an internal combustion engine (not shown) and a surrounding protective cowling, identified by the reference numeral 14. The engine, which may be of any conventional type, has an output shaft that drives a drive shaft journaled for rotation within a drive shaft housing 15 and which drives a propeller 16 of a lower unit 17 through a conventional forward, neutral, reverse transmission (not shown).

Figure 2:
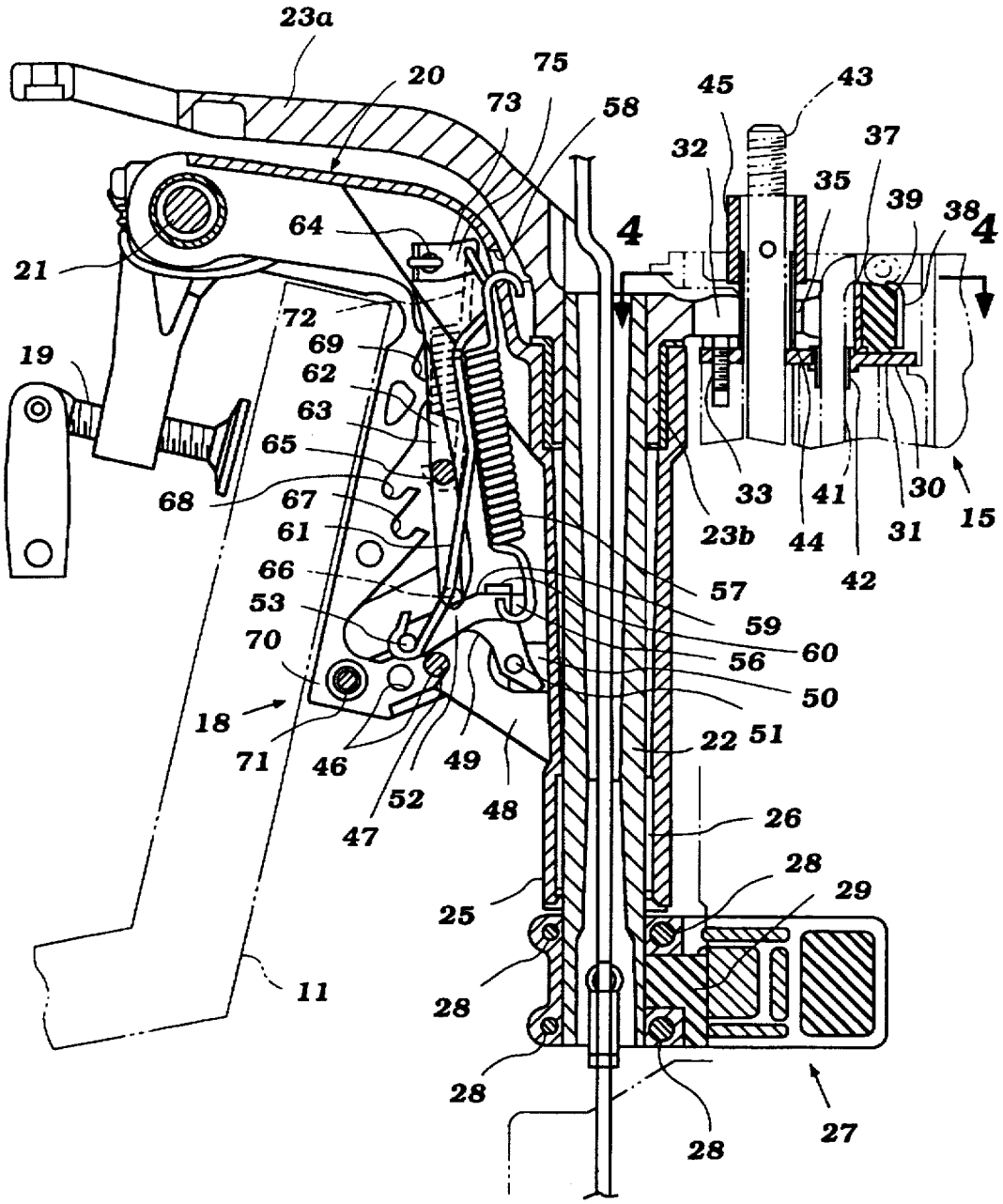
FIG. 2 is an enlarged side elevational view showing the tilting assembly of the present invention in cross-section with the swivel bracket in its tilted-down, locked state.

Referring to FIGS. 1 and 2, a clamp bracket 18 is mounted to the transom 11 through clamp screw 19. A swivel bracket 20 is pivotally mounted to the clamp bracket 18 through a tilt shaft 21 for tilt and trim adjustment of the outboard motor 10. A steering/shaft 22 is affixed to a steering bracket 23*a* and inner sleeve 23*b*, which is attached to the drive shaft housing 15, and is journaled within the swivel bracket 20 for steering of the outboard motor 10 about a generally vertically-extending steering axis. A tiller 24 is connected to the steering bracket 23*a* for controlling the steering of the outboard motor 10. The steering shaft 22 and an inner sleeve 23*b* of the steering bracket 23*a* are journaled for rotation within an outer sleeve 25 of the swivel bracket 20 through a bearing 26.

The steering shaft 22 is connected to a lower part of the drive shaft housing 15 through a lower mount 27 for steering of the outboard motor 10. The lower mount 27 is bracketed to the steering shaft 22 at a front portion of the lower mount 27 through a plurality of screws 28. A shock-absorbing piece 29 is disposed between a rear portion of the lower mount 27 and the steering shaft 22 to absorb vibrations and forces from the motor 10 to the steering shaft 22.

Figure 5:
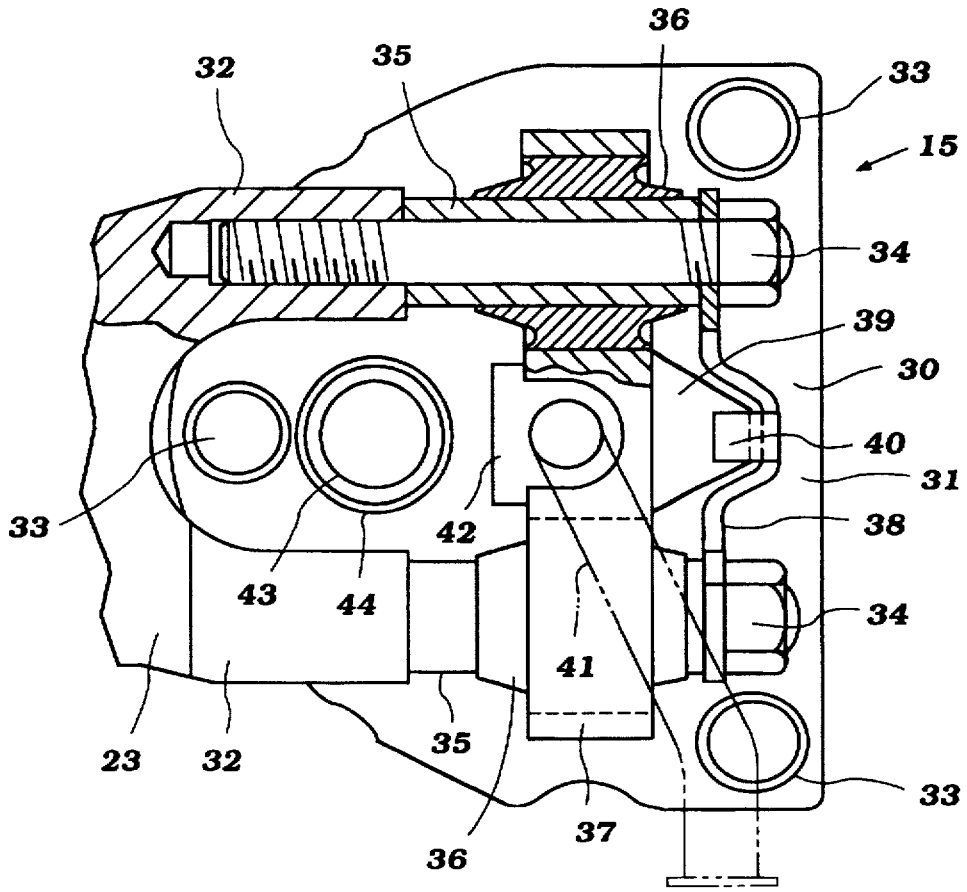
FIG. 5 is a top view of a mounting arrangement between an upper portion of a driveshaft housing and a steering bracket taken along line 5—5 of FIG. 2.

Referring to FIGS. 2 and 5, an upper part of the drive shaft housing 15 is mounted to the steering shaft 22 and steering bracket 23*a* through an upper mount 30. The upper mount 30 includes a mounting plate 31 that gives the upper part of the drive shaft housing 15 more rigidity for steering of the outboard motor 10. The upper mount 30 is mounted to an extension 32 of the steering bracket 22. The mounting plate 31 connects the upper portion of the drive shaft housing 15 to the extension 32 of the steering bracket 23*a* through a plurality of vertically and horizontally-extending bolts, 33 and 34, respectively. The mounting plate 31 is vertically mounted to the steering bracket extension 32 by bolt 33 at the front of the mounting plate 31 and horizontally mounted to extension 32 by bolts 34. Bolts 34 are disposed within a pair of respective cylindrical collars 35 extending from the mounting plate 31. The mounting plate 31 is mounted vertically to the upper part of the driveshaft housing 15 at the rear of the plate 31 by the remaining bolts 33.

A shock-absorbing arrangement is incorporated into the upper mount 30 for reducing vibrations from the outboard motor 10. A pair of respective shock-absorbing members 36 surround cylindrical collars 35. A wall 37 is provided for securing shock-absorbing members 36 in place. A bracket 38 is affixed to one end of the cylindrical collars 35 by bolts 34. A shock-absorbing member 39 is centered between bolts 34 and located between bracket 38 and wall 37. A tooth 40 extends from the bracket 38 for securing shock-absorbing member 39 in place. A water pipe 41 extends vertically through a collar 42 in the mounting plate 31 and is angled horizontally above the mounting plate 31 for delivering water to the engine for cooling purposes. A drive shaft 43 extends through an inner collar 44 and outer collar 45 in the mounting plate 31 for driving the propeller 16.

Referring to FIG. 2, the clamp bracket 18 has a series of trim apertures 46 extending laterally therethrough for receiving a stop pin or member 47 which is engageable with a projection 48 of the swivel bracket 20 for setting the tilted-down position of the swivel bracket 20 and outboard motor 10. Thus, the angle of the outboard motor 10 with respect to the transom 11 of the watercraft may be selectively varied by the operator in accordance with desired operating conditions by inserting the stop pin 47 in the appropriate aperture 46 in the clamp bracket 18.

Locking means are provided on the swivel bracket 20 for releasably engaging the stop pin 47 to retain the swivel bracket 20 and outboard motor 10 in a selected tilted-down position under normal running conditions of the motor 10 and to prevent the motor 10 from popping up when operating in reverse. The releasable locking means comprise a lever 49 which is pivotally mounted at one end to an extension 50 of the swivel bracket by means of a pivot pin 51. A lock arm 52 is pivotally mounted to the lever 49 at its head by means of a pin 53 to lever 49. The lock arm 52 includes a latch 54 that defines a recess 55 (see FIG. 6) that is adapted to selectably engage the stop pin 47 so as to retain the motor 10 in a selected downward running position.

At the opposite end of the lock arm 52, a projection 56 extends horizontally from the arm 52. A spring 57 connects projection 56 of the lock arm 52 to the swivel bracket 20 at aperture 58 in the swivel bracket 20. This spring 57 exerts an upward force on the projection 56 which causes an upper surface 59 of the lock arm 52 to forcibly bear against a tang 60 formed on lever 49 to hold the lock arm 52 in its locked position under normal forward running conditions. A spring (not shown) may also be used to urge the lever 49 in a counterclockwise direction to further assist in retaining the swivel bracket 20 and outboard motor 10 in a tilted-down position, especially when the outboard motor 10 is in reverse.

Releasing means are provided for releasing the above-described locking means and comprise a release link 61 connected at its lower end to the pin 53 of the lock arm 52 and connected at its upper end with a single-piece lever 73, to be described.

In addition to the locking and releasing means, the tilting assembly is also equipped with a holding means for holding the swivel bracket 20 and outboard motor 10 in a desired tilted-up position. This holding means has a special operative relationship with the locking means through the single-piece lever 73 described below. The holding means comprises a holder arm 62 which includes a pair of generally L-shaped members 63 that are each pivotally mounted near opposite ends of a support shaft 64 for independent rotation with respect to the shaft 64. These L-shaped members 63 are interconnected by a rod 65 so that they will pivot as a unit. Each of these L-shaped members 63 has a horizontal segment 66 which extends from the holder arm 62 outwardly in an opposite direction from its counterpart. These horizontal segments 66 are selectively engageable with a series of notched holder portions or notches 67, 68 and 69, formed in rearwardly extending plate portions 70 of the clamp bracket 18. The rearwardly extending plate portions 70 are connected to the rest of the clamp bracket 18 through threaded fasteners 71. An over-the-center spring 72 connects the rod 65 of the holder arm 62 and the single-piece lever 73 for urging the holder arm 62 either away from or towards the notched portions 67–69 in a manner to be described.

Figure 4:
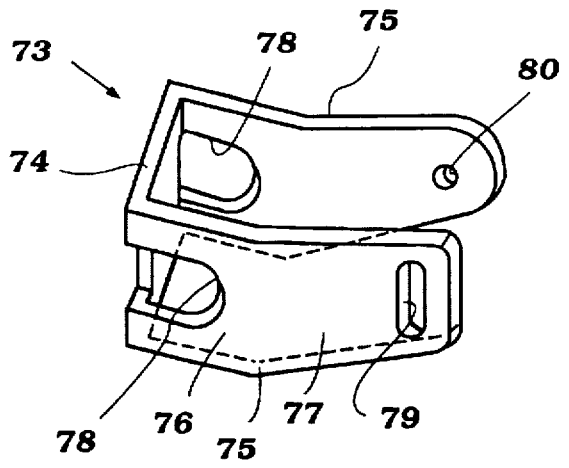
FIG. 4 is a perspective view of the single-piece lever of the present invention.

Referring to FIGS. 2 and 4, the single-piece lever 73 functions to engage and disengage the lock arm 52 and holder arm 62 for tilt locking and holding of the outboard motor 10. The single-piece lever 73 is pivotally mounted to the swivel bracket 20 through the support shaft 64. An independent operating lever (not shown) is mounted to the support shaft 64 for operating the single-piece lever 73. The single-piece lever 73 includes a front face 74 and two adjoining parallel sidewalls 75. Each of the opposing sidewalls 75 include a generally rectangular portion 76 and an angled portion 77. The front face 74 and the adjoining side walls 75 include a hole 78 in which the support shaft 64 is disposed for rotation of the single-piece lever 73 with the support shaft 64. In the angled portion 77 of one of the sidewalls 75, a slot 79 is provided for connecting one end of the release link 61 to the lever 73. In the other angled portion 77 of the opposite side wall 75, an aperture 80 is provided for connecting one end of the spring 72 to the lever 73.

The tilting assembly further includes biasing means for biasing the holder arm 62 towards, or away from, the notched portions 67–69 of the clamp bracket 18. The biasing means takes the form of the over-the-center spring 72 connected at one end to the single-piece lever 73 and connect at the other end to the rod 65 of the holder arm 62. When the single-piece lever 73 is rotated clockwise of an over-the-center position above the shaft 64, the holder arm 62 is biased away from the notched portions 67–69, as shown in FIG. 2. When the swivel bracket 20 and outboard motor 10 are in the tilted-down and locked position, the lever 73 is rotated fully clockwise, so that the holder arm 62 is biased away from the notched portions 67–69. This prevents the holder arm 62 from accidentally engaging one of the notched portions 67–69 if the outboard motor 10 and swivel bracket 20 suddenly rotate about the tilt shaft 21 upon striking an underwater obstacle.

Figure 6:
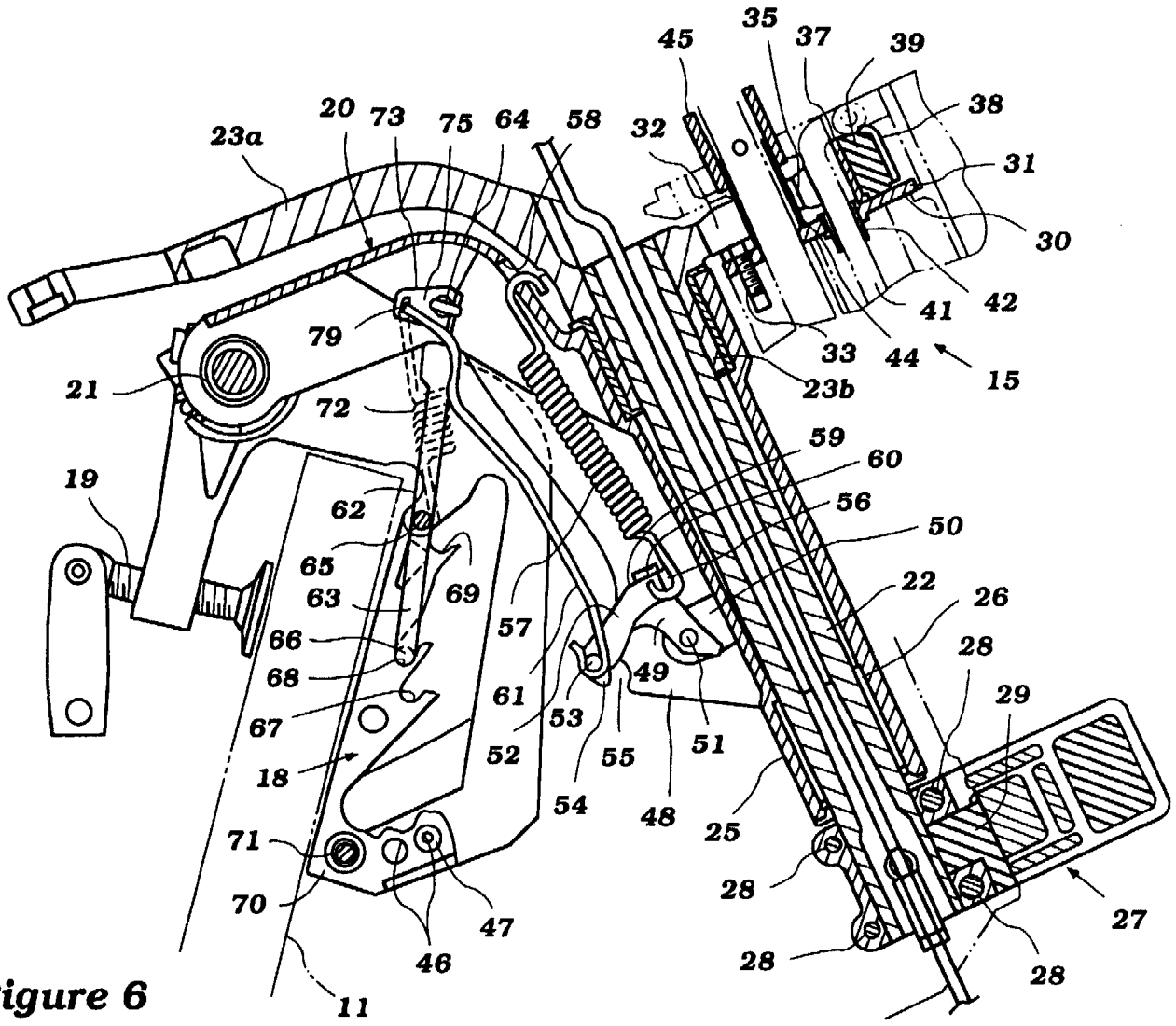
FIG. 6 is an enlarged side elevational view of the tilting assembly of the present invention shown in cross-section with the swivel bracket in its tilted-up, unlocked state.

Additionally, the lever 73 is rotated fully clockwise upon lowering the outboard motor 10 after removing the holder arm 62 from one of the notched portions 67–69 so that the holder arm 62 is urged away from the notched portions 67–69 and does not catch on them. When the single-piece lever 73 is rotated counter-clockwise so that the lever 73 passes the over-the-center position above the shaft 64, as shown in FIG. 6, the spring 72 biases the holder arm 62 so that it is urged towards the notched portions 67–69 of the clamp bracket 18. The lever 73 is rotated fully counter-clockwise when raising the motor 10 to a tilted-up position so that the holder arm 62 is urged against the notched portions 67–69 to facilitate engagement of the horizontal segments 66 with the desired notched portions 67–69 when the desired tilted-up position is determined.

The operation of the tilt locking and holding assembly of the present invention will now be described with particular reference to FIGS. 2, 3 and 6. Referring to FIG. 2, to release the latch 54 of the lock arm 52 from the stop pin 47, the single-piece lever 73 is rotated from a full clockwise position, as shown in FIG. 2, towards a full counter-clockwise position, as shown in FIG. 5. Rotation of the lever 73 in this manner places tension on the release link 61 to draw the lock arm 52 and lever 49 in an upward, clockwise direction about pivot pin 51 against the spring force exerted on the arm 52 and lever 49 by spring 57 to release the lock arm 52 from the stop pin 47. The single-piece lever 73 is configured so that when the lever 73 is rotated to an above-the-center position in relation to the shaft 64, the lock arm 52 no longer interferes with the stop pin 47, and the swivel bracket 20 and motor 10 may be freely tilted. Simultaneously, as the lever 73 moves through the above-the-center position, the spring 72 goes from biasing the holder arm 62 away from the notch portions 67–69 to biasing the holder arm 62 towards the notched portions 67–69.

Figure 3:
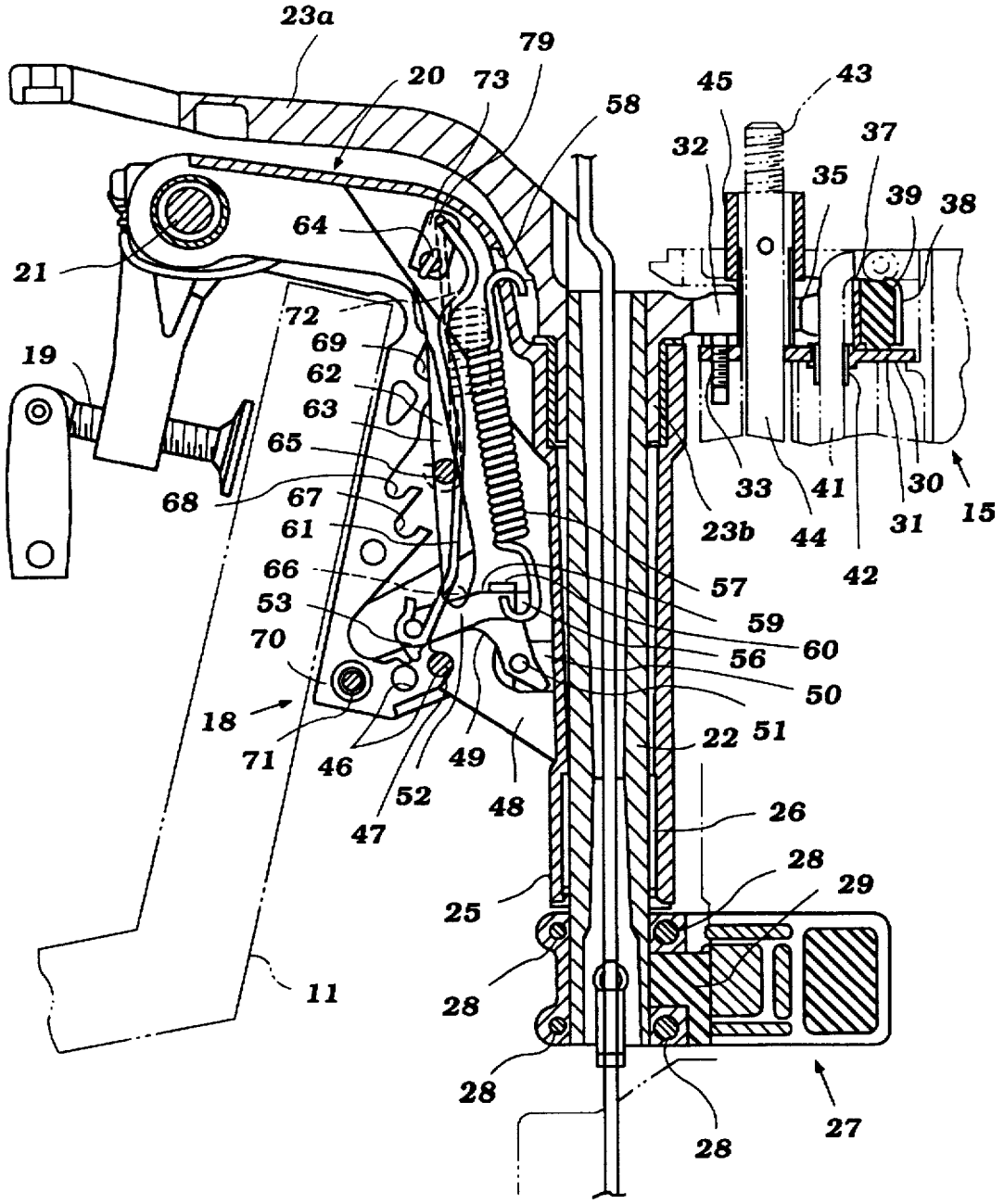
FIG. 3 is an enlarged side elevational view of the tilting assembly of the present invention shown in cross-section, showing the swivel bracket in its tilted-down, unlocked state.

FIG. 3 also illustrates what happens to the latching assembly when the outboard motor 10 strikes an underwater obstacle. The configuration of the lock arm 52 and the amount of force applied by spring 57 to lock arm 52 are designed so that when the outboard motor 10 strikes an underwater obstacle, the lock arm 52 will release to prevent damage to the outboard motor 10 or transom 11 of the boat. Movement of the lock arm 52 caused from striking an underwater obstacle imparts a force on the single-piece lever 73 through the release link 61 causing the lever 73 to rotate in a counter-clockwise fashion. However, the spring 72 prevents the lever 73 from rotating past the above-the-center position. Thus, the holder arm 62 is prevented from being biased against and engaging the notched portions 67–69 upon rotation of the swivel bracket 20 and outboard motor 10 caused from striking an underwater obstacle.

After the single-piece lever 73 is rotated past the above-the-center position, the holder arm 62 will be biased against the notched portions 67–69 of the clamp bracket 18 so that the outboard motor 10 may be tilted up. The holder arm 62 is now in position to engage one of the notched holder portions 67–69. It should be noted that rotation of the single-piece lever 73 to its full counter-clockwise position will not cause the lock arm 52 and lever 49 to rotate any further because the upper end of the release link 61 will slide forwardly within the slot 79 of the lever 73. As the swivel bracket 20 and outboard motor 10 are tilted up, the horizontal segments 66 of the holder arm 62 rise along the plate portions 70 of the clamp bracket 18. To engage the holder arm 62, the motor 10 is tilted up to a point slightly above the selected holder notch 67–69 and then lowered slightly so that the horizontal segments 66 engage the selected notch 67–69 to hold the swivel bracket 20 and outboard motor 10 in a selected tilted-up position.

The lower notched portion 67 is located so that when the watercraft is in the water and the holder arm 62 is engaged with that notched portion 67, the propeller 16 is still positioned below the water surface. With this arrangement, the lower notched portion 67 may be used for running the motor 10 in shallow water.

To lower the outboard motor 10, it is first raised slightly and the single-piece lever 73 is rotated to its full clockwise position so as to release and bias the holder arm 62 away from the notched portions 67–69. The outboard motor 10 may then be returned to a normal tilted-down running position. Before the swivel bracket projection 48 engages the stop pin 47, the head of the lock arm 52 contacts the stop pin 47, causing the lock arm 52 and lever 49 to rotate in a clockwise direction until projection 48 engages the stop pin 47 and the lock arm 52 snaps into an engaged position with the pin 47 in recess 55 to retain the outboard motor 10 in the tilted-down running position.

It should be readily apparent from the foregoing description that embodiments of a highly effective, yet simple and easy-to-use, tilt retaining and holding assembly operable by a single-piece lever has been illustrated and described. Although this is the case, it is to be understood that various changes and modifications may be made without departing from the spirit and scope of the invention, as defined by the appended claims.

What is claimed is:

1. A tilting assembly for an outboard motor drive unit comprising a clamp bracket having a holder portion, said clamp bracket being adapted to be affixed to a transom of an associated watercraft, a swivel bracket pivotally mounted to said clamp bracket for tilting movement between a tilted-down position and a tilted-up position, a stop member secured to said clamp bracket, locking means for locking said swivel bracket to said stop member for setting said tilted-down position, said locking means being pivotally mounted to said swivel bracket and selectively engageable with said stop member, releasing means for releasing said locking means from said stop member, said releasing means being pivotally mounted to said swivel bracket, holding means for holding said swivel bracket in said tilted-up position in cooperation with said holder portion of said clamp bracket, said holding means being pivotally mounted to said swivel bracket and selectively engageable with said holder portion, biasing means for biasing said holding means towards said holder portion or away from said holder portion, said biasing means being pivotally mounted to said swivel bracket, said biasing means and said releasing means being pivotally mounted to said swivel bracket through a single-piece lever, and said biasing means being operatively associated with said releasing means and said single-piece lever being configured so that said holding means is biased away from said holder portion when said stopping member is engaged by said locking means and towards said holder portion when said stopping member is disengaged from said locking means.

2. The tilting assembly of claim 1, wherein said locking means include a swivel bracket projection that is engageable with said stopping member, a lever pivotally mounted at one end to the swivel bracket, a tang extending from said lever at a point intermediate said pivotally mounted end and an opposite end, a lock arm pivotally mounted to the lever at an end opposite to the end mounted to the swivel bracket, said lock arm including a latch, said latch defining a recess and adapted to selectably engage said stop member, a spring connecting said lock arm to said swivel bracket, said spring exerting a force on said lock arm so as to cause said lock arm to bear against said tang causing said lock arm to remain in a locked position.

3. The tilting assembly of claim 2, wherein said releasing means comprising a release link connecting said single-piece lever to said lock arm and said lever.

4. The tilting assembly of claim 3, wherein said holding means include a holder arm, said holder arm includes a pair of L-shaped members that are engageable with said holder portion for supporting the swivel bracket, said L-shaped members pivotally mounted to said swivel bracket, a rod connecting said L-shaped members so that said holder arm pivots as a single unit.

5. The tilting assembly of claim 4, wherein said biasing means include a spring connecting said single-piece lever to said holder arm so that holder arm is biased away from said holder portion when said locking arm is in a locked position with said stopping member and towards said holder portion when said locking arm in an unlocked position with said stopping member.

6. The tilting assembly of claim 2, wherein said single-piece lever includes a face and two generally parallel sidewalls, said sidewalls include a generally rectangular portion integral with an angled portion, said sidewalls include aligned shaft holes for pivotally mounting said lever to said swivel bracket, one of said sidewalls also includes a slot for connecting said release means, said other sidewall also includes a hole for connecting said biasing means.

7. The tilting assembly of claim 6, wherein said releasing means include a spring connecting said single-piece lever to said locking means, said spring slidably disposed in said slot of said single-piece lever, said biasing means include a spring connecting said single-piece lever to said holding means.

* * * * *